United States Patent [19]

Dalmau Güell

[11] Patent Number: 4,571,958

[45] Date of Patent: Feb. 25, 1986

[54] YARN FEEDER FOR CIRCULAR KNITTING MACHINE EQUIPPED WITH STRIPERS

[75] Inventor: José M. Dalmau Güell, Barcelona, Spain

[73] Assignee: Jumberca, S.A., Badalona, Spain

[21] Appl. No.: 656,854

[22] Filed: Oct. 2, 1984

[30] Foreign Application Priority Data

Oct. 7, 1983 [ES] Spain ..... 526.626

[51] Int. Cl.[4] ..... D04B 15/48

[52] U.S. Cl. ..... 66/132 R; 226/152; 226/185

[58] Field of Search ..... 66/132 R, 132 T; 226/152, 185

[56] References Cited

U.S. PATENT DOCUMENTS 3,739,603 6/1973 Philip ..... 66/132 R
4,026,127 5/1977 McCreary et al. ..... 66/132 R
4,489,899 12/1984 Calamani et al. ..... 66/132 T X

FOREIGN PATENT DOCUMENTS 1946559 3/1971 Fed. Rep. of Germany .... 66/132 R

*Primary Examiner*—Wm. Carter Reynolds
*Attorney, Agent, or Firm*—Staas & Halsey

[57] ABSTRACT

A yarn feeder for a circular knitting machine having stripers receiving the yarns from the machine creel, each yarn following a set route through a plurality of fixed eyelets and moving eyelets located on a pivotable arm. The pivoting of the arm causes the length of yarn comprised between the eyelets to move between two rollers the rotation of which pulls the yarn along from the creel and delivers it to the needle which previously, while the arm was being caused to pivot, received the loop of yarn contained between two moving eyelets and a fixed eyelet.

7 Claims, 3 Drawing Figures

YARN FEEDER FOR CIRCULAR KNITTING MACHINE EQUIPPED WITH STRIPERS

BACKGROUND OF THE INVENTION

This invention relates to a yarn feeder for a circular knitting machine equipped with stripers, particularly for application to the stripers associated with each set of machine cams and with a needle removal area of the needle cylinder and comprising a set of yarn guides selectively driven by a selector arrangement controlled by a control synchronised with the machine rotation and acting only once at the most on each of the selection arrangements on each rotation of the machine.

DESCRIPTION OF THE PRIOR ART

Circular knitting machines of the aforesaid type have the stripers thereof located on the periphery and in such a way as for there to be one device for each set of cams, each of them receiving four yarns, three of which are retained by the striper and the other of which is selectively fed to the needles.

Generally the changeover of the yarn fed by the striper to the needles is effected once at the most on each rotation of the machine in one same needle cylinder zone. This zone is known as the needle removal area, having a width of 20 to 30 needles, at the start of which certain needles are removed, whereas in the remaining portion the needle density is less than in the remainder of the cylinder.

In the yarn changeover process, the yarn to be inserted is offered up so that the needles receive it and start knitting even while the previous yarn is still being knitted, whereby for a short period of time two yarns are being knitted, namely the incoming yarn and the outgoing one.

Then, in view of the above, conventionally it is not possible positively to feed circular knitting machines equipped with stripers, since, the feed being constant and simultaneous for each and every one of the yarns, only one of every four yarns is knitted by the needles, the change is effected selectively depending on the characteristics of the fabric to be knitted and on the rotations on which there is no yarn changeover, there appears equally the needle removal zone in which, particularly in terry fabrics, the amount of yarn necessary for the needles varies considerably.

SUMMARY OF THE INVENTION

The object of the invention is to provide a yarn feeder capable of overcoming the above drawbacks and of feeding the yarns selectively.

The feeder of the invention is characterised by comprising:

(a) a fixed frame carrying two mutually parallel rotatable shafts, one being a primary shaft and being provided with a smooth cylindrical roller and a drive pulley and the other is a secondary one, carrying equidistant partly tapering and partly cylindrical driven rollers, the cylindrical portion of which engages said smooth cylindrical roller;

(b) operating spaces between the cylindrical roller and each of the driven rollers in which a moving yarn may pass;

(c) a plurality of inlet eyelets receiving the yarns from a creel and disposed on a sloping support attached to the frame on the outside of the circular knitting machine;

(d) a plurality of intermediate eyelets receiving the yarns from the rollers, disposed on a support attached to the frame;

(e) a plurality of arms pivoting around axes contained respectively on the median planes of the tapered portion of the driven rollers, mounted on the fixed frame and being provided at one end thereof with a yarn guide eyelet for the yarn fed by the inlet eyelets to the rollers, whereas at the other end they are provided with a ring receiving the yarn from the intermediate eyelets and with a terminal eyelet from whence the yarn moves to the needles, said eyelet being adapted, by the pivoting of the corresponding arm for assuming a position in which the yarn comprised between the said eyelet and the intermediate eyelet is trapped between the cylindrical roller and a cylindrical portion of the driven roller and consequently said yarn is fed by said rollers;

(f) a plurality of change of direction eyelets mounted on a horizontal curved support attached to the frame on the inside of the circular knitting machine, located in such a way that the sum of the distances from each of them to the ring and to the terminal eyelet of the corresponding arm, at the same angle of pivoting, is the same for all of them;

(g) springs urging the arms in the sense of keeping the yarn always under tension;

(h) adjusting means for the pivoting arm springs.

BRIEF DESCRIPTION OF THE DRAWINGS

Further objects and characteristics of the invention will be disclosed in detail in the following description, to be read in connection with the attached drawings, in which.

DETAILED DESCRIPTION

Figure 1:
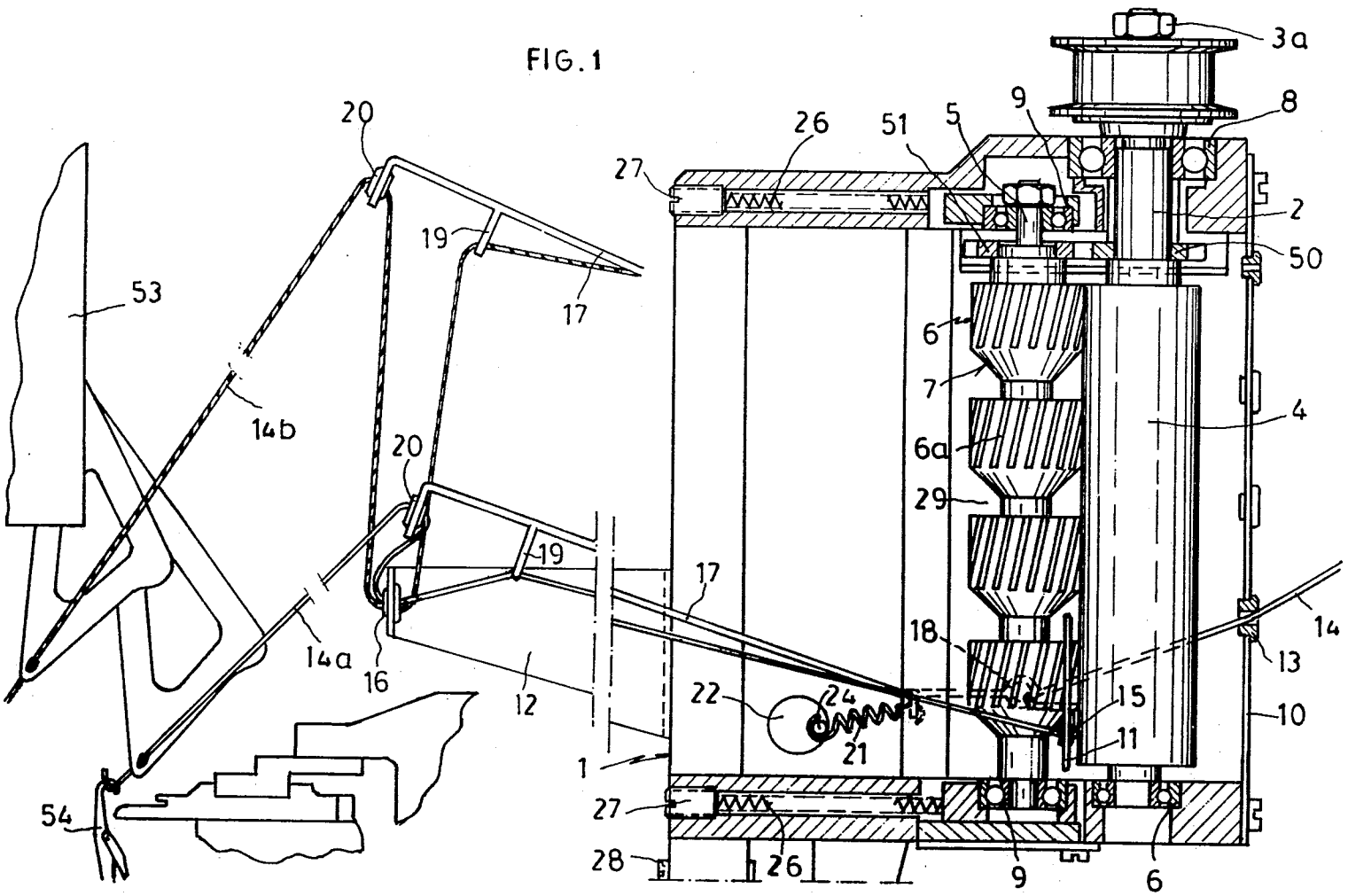
FIG. 1 is an elevation view, partly in section, of the feeder of the invention, only two arms and the striper and one needle being schematically shown.
Figure 2:
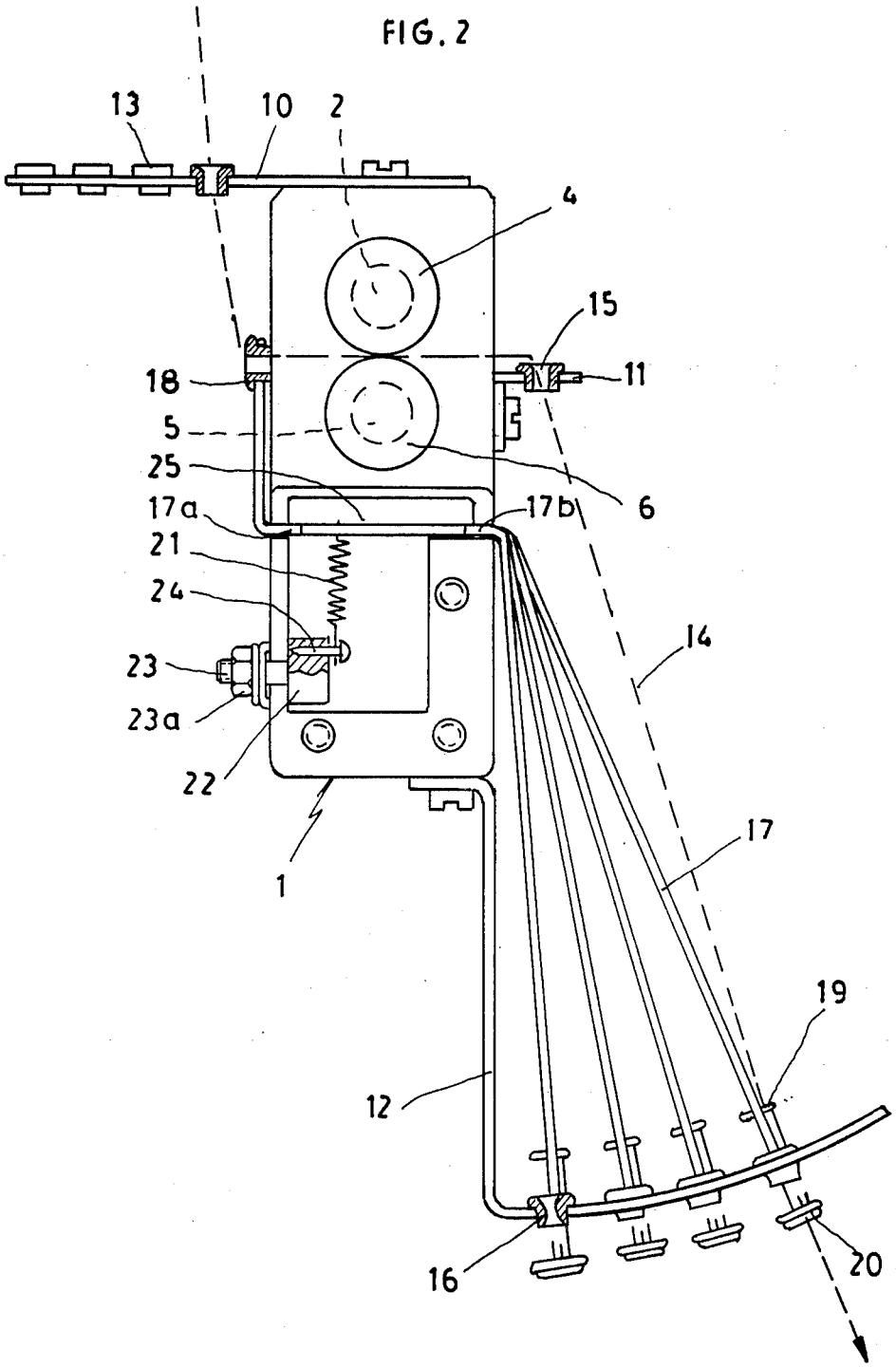
FIG. 2 is a plan view of the feeder, showing the four usual arms.

The yarn feeder of the invention for circular knitting machines comprises a fixed frame 1 in which there are mounted a rotatory primary shaft 2 driven by an external drive pulley 3, held in place by a nut 3*a* and being provided with a smooth cylindrical roller 4 covered with rubber, and a secondary shaft 5 parallel to the former and being provided with a plurality of driven rollers 6 having a cylindrical portion 6*a* engaging the smooth roller 4 and a tapered portion 7. The cylindrical portion 6*a* is preferably axially striate. The rollers 6 are preferably driven by a gear 50 attached to the shaft 2 and meshing with a further gear 51 attached in turn to the shaft 5, although the rollers 6 may be driven by friction from the roller 4. Also preferably the diameter of roller 4 is slightly larger (about 5 to 20%) than the diameter of the rollers 6. For example, the diameter of the smooth cylindrical roller 4 lies between 1.05 and 1.20, and preferably 1.10, times the diameter of the cylindrical portion of the driven rollers. In this case, when the rollers are driven by the gears 50, 51, a sliding action occurs between the respective surfaces thereof, producing the effects described hereinafter.

Said shafts 2 and 5 are mounted in respective ball bearings 8 and 9.

Mounted in the frame 1 there are supports 10, 11 and 12 to be described hereinbelow. The support 10 is inclined and is provided with a plurality of eyelets 13 through which pass the yarns 14 from the machine creel. Supports 11 and 12 are provided with further pluralities of eyelets 15 and change of direction eyelets 16 guiding the yarns 14 through the feeder as described below, support 11 being vertical and close to the plane tangent to both rollers 4,6 and support 12 being horizontal and curved.

Figure 3:
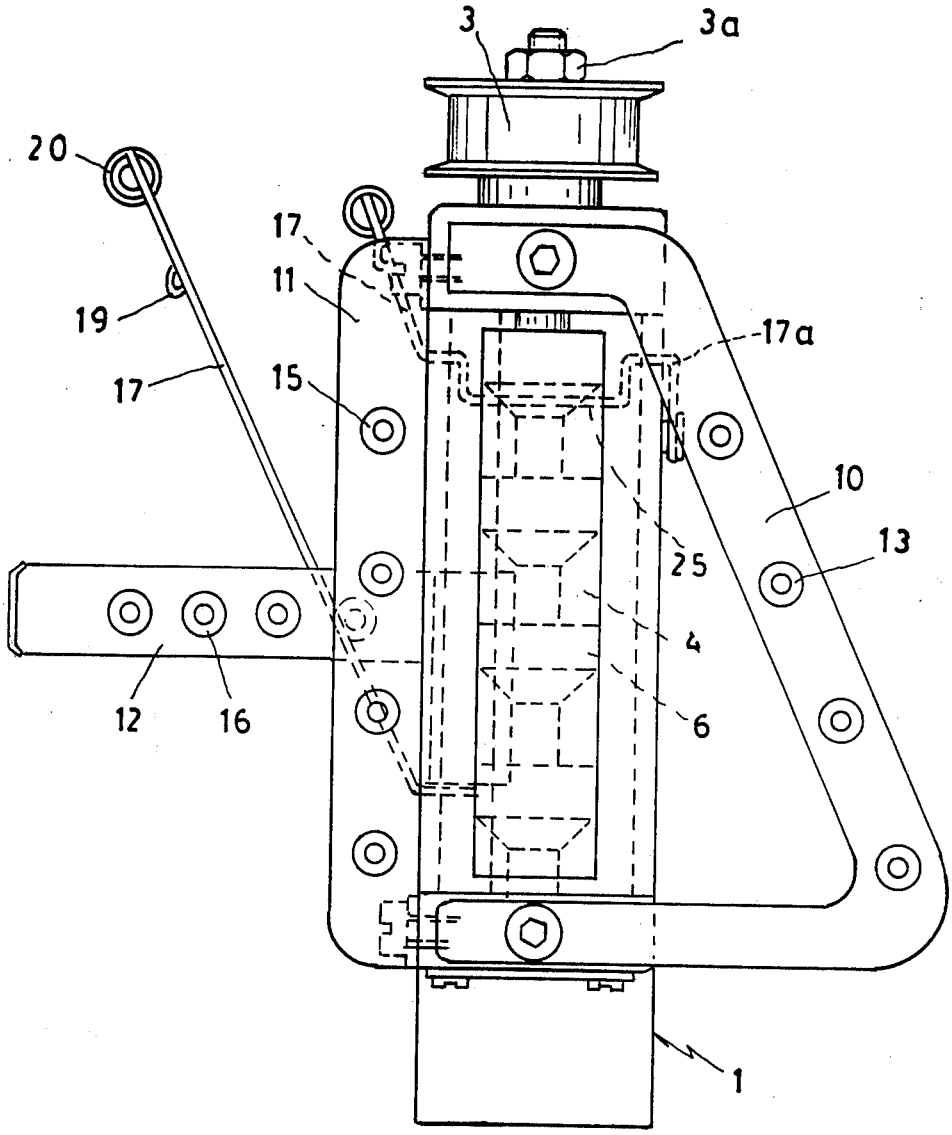
FIG. 3 is a side view of the feeder.

Pivoting arms 17 are also supported on the frame 1 and are provided at one end thereof with an eyelet 18 for the yarn 14, whereas at the other end they are provided with a ring 19 and terminal eyelet 20 for the yarn towards the machine's needles. Each arm pivots about a corresponding axis (FIG. 3) contained generally in the median plane of the cylindrical portion 6*a* of the corresponding driven roller 6.

The pivoting arms 17 are provided with a traction spring 21 tending to draw the arms to an inoperative position, said springs having one end attached to tension adjusting device comprising a stud 22 with shaft 23 which may conveniently be set by a nut 23*a* and is provided with an offset pin 24 for holding the spring. The other end of the said springs 21 is attached to an intermediate elbow portion 25 of the corresponding arm 17. Thereby, for one same angle of pivoting of any of the arms, the amount of yarn stored between the ring 19, eyelets 16 of the support 12 and the eyelet 20 is always the same. There is a set of spring 21 and stud 22 for each arm, although only one set has been shown in FIG. 1 for clarity.

To engage the rollers 6 of the secondary shaft 5 with the cylindrical roller 4, there are springs 26 urging said shaft under a pressure regulatable by a screw 27.

The frame unit 1 is attached to the pertinent machine bedframe by binding screws 28.

In the example described, there are four arms 17 and sets of fixed eyelets 13, 15 and 16, since this is the usual number of yarns used in the said knitting machines, although the number may be different as desired.

Of the four yarns 14 used in the feeder as described, only one, namely the yarn previously selected by the striper 53, is being knitted, the remaining yarns being inoperative.

The yarn 14 selected at any one time is drawn in by the machine needles 54, pulling the corresponding arm 17 downwards against the opposition of the spring 21, without the arm 17 contacting the horizontal support 12 in any case, since the tension of the yarn 14 balances the tension of the spring 21, causing the yarn to move from the tapered portion 7 of the roller 6 on to the cylindrical portion to be trapped between the two rollers 6, 4. Since the cylinder 4 is driven to rotate, this causes the yarn to be pulled from the corresponding bobbin on the machine creel.

Under the above conditions, the selected yarn runs from the creel and enters the feeder through the eyelet 13 and from there to the inlet eyelet 18 of the arm 17, from which it is directed to the cylinders 4 and 6 as explained above where it runs through an operating space 29. Thereafter it passes through an eyelet 15 to be guided towards the ring 19 of the arm 17 and from there to the fixed eyelet 16, to terminate through the outlet eyelet 20 of the arm 17 and continue towards the needles 54. As may be seen from FIG. 1, when an arm 17 is activated, it pivots towards the support 12 of the eyelets 16, shortening the lengths formed successively between the ring 19 and the eyelets 16 and 20. When the arm 17 is in a rest position, the amount of yarn 14 fed in excess to the needles never exceeds the amount that may be stored between the ring 19, the eyelet 16 and the terminal eyelet 20 so that at any one time the feeder tensions the yarn with a constant tension irrespective of whether the yarn is being fed or not.

In other words, the striper 53 selects one of the yarns 14, shown as 14*a* in FIG. 1 and which is, therefore, the yarn which will be knit. The remaining yarns, such as 14*b* in FIG. 1 are not knit since they have not been selected. The needle 54 draws the yarn 14*a*, whereby the needle is fed at the expense of the loop of yarn comprised between the eyelet 20, the fixed eyelet 16 and the ring 19 of the same arm 17. As the yarn from this loop is consumed, the arm 17 pivots downwardly about its axis. Thereby, the part of the arm terminating with the eyelet 18 moves out of the position located at the height of the operating space 29 and rises up to the height of the cylindrical portion 6*a* of the corresponding roller 6. Consequently, the portion of yarn lying between the eyelet 18 of the arm 17 and the eyelet 15 of the support 11, passes to run between the cylindrical portion 6*a* of the roller 6 and the roller 4 and it is the movement of these rollers that drives the yarn along for the needle 54 to receive the necessary yarn without the needle 54 being subjected to undue stress.

The aforementioned sliding action prevents any sizing on the yarn from being deposited on the roller 4.

What I claim is:

1. A yarn feeder for a circular knitting machine, comprising:

(a) a fixed frame carrying two mutually parallel rotatable shafts, one being a primary shaft and being provided with a smooth cylindrical roller and a drive pulley and the other being a secondary one, carrying equidistant partly tapering and partly cylindrical drive rollers, the cylindrical portion of which engages said cylindrical roller;

(b) operating spaces between the cylindrical roller and each of the driven rollers in which a moving yarn may pass;

(c) a plurality of inlet eyelets receiving the yarns from a creel and disposed on a sloping support attached to the frame on the outside of the circular knitting machine;

(d) a plurality of intermediate eyelets receiving the yarns from the rollers, disposed on a support attached to the frame;

(e) a plurality of arms pivoting around an axis contained respectively on the median planes of the tapered portion of the driven rollers, mounted on the fixed frame and being provided at one end thereof with a yarnguide eyelet for the yarn fed by the inlet eyelets to the rollers, whereas at the other end they are each provided with a ring receiving the yarn from the intermediate eyelets and with a terminal eyelet from whence the yarn moves to needles, said eyelet being adapted, by the pivoting of the corresponding arm for assuming a position in which the yarn between said eyelet and the intermediate eyelet is trapped between the cylindrical roller and a cylindrical portion of the driven roller and consequently said yarn is fed by said rollers;

(f) a plurality of change of direction eyelets mounted on a horizontal curved support attached to the frame on the inside of the circular knitting machine, located in such a way that the sum of the distances from each of them to the ring and to the terminal eyelet of the corresponding arm, at the same angle of pivoting, is the same for all of them;

(g) springs urging the arms in the sense of keeping the yarn always under tension; and (h) adjusting means for the pivoting arm springs.

2. The yarn feeder of claim 1, wherein the adjusting means of the spring for each pivoting arm comprises an adjustable position rotatable stud having an offset on which one end of the spring is anchored.

3. The yarn feeder of claim 1, wherein each pivoting arm is associated with the spring therefor at an elbow portion intermediate the points of pivoting of said arms.

4. The yarn feeder of claim 1, wherein the driven rollers are driven in rotation by a gear attached with the primary shaft meshing with a gear attached with the shaft of the driven rollers.

5. The yarn feeder of claim 4, wherein the diameter of the smooth cylindrical roller is greater than the diameter of the cylindrical portion of the driven rollers.

6. The yarn feeder of claim 5, wherein the diameter of the smooth cylindrical roller lies between 1.05 and 1.20, preferably 1.10 times the diameter of the cylindrical portion of the driven rollers.

7. The yarn feeder of claim 1, wherein the cylindrical portion of the driven rollers is substantially axially striate.

* * * * *